United States Patent [19]

Kuno

[11] Patent Number: 5,051,344

[45] Date of Patent: Sep. 24, 1991

[54] SILVER HALIDE PHOTOGRAPHIC MATERIAL

[75] Inventor: Koichi Kuno, Kanagawa, Japan

[73] Assignee: Fuji Photo Film Co., Ltd., Kanagawa, Japan

[21] Appl. No.: 431,498

[22] Filed: Nov. 3, 1989

[30] Foreign Application Priority Data

Nov. 4, 1988 [JP] Japan ..... 63-278590

[51] Int. Cl.[5] ..... G03C 5/24

[52] U.S. Cl. ..... 430/434; 430/567; 430/604; 430/605

[58] Field of Search ..... 430/567, 605, 604, 434

[56] References Cited

U.S. PATENT DOCUMENTS

| | | | |
|---|---|---|---|
| 4,588,678 | 5/1986 | Ikeda | 430/420 |
| 4,613,563 | 9/1986 | Murai | 430/940 |
| 4,639,416 | 1/1987 | Yoshida et al. | 430/567 |
| 4,692,400 | 9/1987 | Kumashiro et al. | 430/553 |
| 4,713,318 | 12/1987 | Sugimoto et al. | 430/569 |
| 4,728,602 | 3/1988 | Shibahara et al. | 430/567 |
| 4,806,462 | 2/1989 | Yamashita et al. | 430/604 |
| 4,857,450 | 8/1989 | Burrows et al. | 430/605 |
| 4,963,467 | 10/1990 | Ishikawa et al. | 430/567 |
| 4,983,509 | 1/1991 | Inoue et al. | 430/567 |

FOREIGN PATENT DOCUMENTS

| | | | |
|---|---|---|---|
| 750430 | 10/1970 | Belgium | 430/604 |

*Primary Examiner*—Charles L. Bowers, Jr.
*Assistant Examiner*—Thomas R. Neville
*Attorney, Agent, or Firm*—Sughrue, Mion, Zinn Macpeak & Seas

[57] ABSTRACT

There is disclosed a silver halide photographic material comprising a support having provided thereon at least one silver halide photosensitive emulsion layer, wherein said silver halide photosensitive emulsion layer contains silver iodobromide grains having a silver iodide content of 0.1 to 4.0 mol %, said grains containing $5\times10^{-9}$ to $1\times10^{-6}$ mole of an iridium compound and $5\times10^{-8}$ to $1\times10^{-3}$ mole of an iron compound per mole of the silver halide in said silver iodobromide grains, and a method for forming an image comprising the silver halide photographic meterial to a high-irradiation short-duration exposure followed by development. The photographic material has high speed, high contrast and is outstanding in handling properties under a safelight.

11 Claims, No Drawings

SILVER HALIDE PHOTOGRAPHIC MATERIAL

FIELD OF THE INVENTION

This invention relates to silver halide photographic materials. More specifically, it relates to silver halide photographic materials which have a high speed and high contrast and are outstanding in their handling properties upon high-irradiation short-duration exposure.

BACKGROUND OF THE INVENTION

In recent years, scanner systems have been widely used in the field of printing platemaking. There are various recording devices which employ image-forming methods using a scanner system, and the recording light sources for these scanner system recording devices include glow lamps, xenon lamps, tungsten lamps, LED's, He-Ne lasers, argon lasers, semiconductor lasers and the like.

Various characteristics are required of photosensitive materials used in such scanners, and in particular, since they are exposed with a short-duration exposure of $10^{-3}$-$10^{-9}$ seconds, it is an indispensable condition that they are of a high speed and high contrast even under such conditions. In the field of facsimiles in particular, it is important that they are outstanding in their applicability to rapid processing since a rapid information transferability is regarded as important, and there has been a strong demand for the development of photosensitive materials having a high speed and high contrast since there is a desire to increase the line count and contract the light beam for purposes of increasing the speed of scanning and obtaining a high image quality in the future.

Iridium compounds are effective in increasing the speed, hardening the gradation and improving development acceleration properties in view of such requirements, and techniques involving these are described, for example, in JP-A-48-60918, JP-A-58-211753, JP-A-61-29837, JP-A-61-201233 and JP-B-48-42172 (as used herein, the term "JP-A" means an "unexamined published Japanese patent application" and the term "JP-B" means an "examined Japanese patent publication").

However, silver halide emulsions in which iridium salts have been introduced frequently end up by also improving the low-intensity reciprocity failure while simultaneously improving the high-intensity reciprocity failure. For this reason, there has been the problem that the handling properties in a safelight are markedly impaired.

In order to resolve such problems, the coloring of a photographic emulsion layer or another hydrophilic colloid layer is often carried out by means of colorants which absorb light of a specific wavelength region. Such techniques are described, for example, in U.S. Pat. Nos. 1,845,404, 2,493,747, 3540,887, 3,560,214, JP-B-31-10578 and JP-B-39-22069. However, even though the use of such colorants frequently has little effect on the photographic emulsion itself, there are the disadvantages that they bring about spectral sensitization in unnecessary regions in spectrally sensitized emulsions and they bring about a reduction in speed which is thought to originate in the desorption of sensitizing dyes.

In addition, they can remain after processing due to the greater rapidity of development processing which has come to be carried out in recent years. There have been proposals to use dyes with a high reactivity with sulfite ions in order to overcome this, but there are the disadvantages that the stability in the photographic film is not sufficient in such cases, there is a reduction in density over time and the desired photographic effects are not obtained.

SUMMARY OF THE INVENTION

A first objective of this invention is to provide silver halide photographic materials which have a high speed and a high contrast in a high-illuminance short-duration exposure.

A second objective of this invention is to provide silver halide photographic materials which are outstanding in their applicability to rapid processing.

A third objective of this invention is to provide silver halide photographic materials which are outstanding in their handling properties under a safelight illumination.

The above mentioned objectives of this invention are achieved by a silver halide photographic material comprising a support having provided thereon at least one silver halide photosensitive emulsion layer, wherein said silver halide photosensitive emulsion layer contains silver iodobromide grains having a silver iodide content of 0.1 to 4.0 mol %, said grains containing $5\times10^{-9}$ to $1\times10^{-6}$ mole of an iridium compound and $5\times10^{-8}$ to $1\times10^{-3}$ mole of an iron compound per mole of the silver halide in said silver iodobromide grains.

DETAILED DESCRIPTION OF THE INVENTION

The specific structure of the invention is now discussed in detail.

The silver halide grains in accordance with this invention are silver iodobromide essentially containing no silver chloride and their average silver iodide content is 0.1 mol % to 4.0 mol % and preferably 0.5 to 2 mol %, the balance consisting essentially of silver bromide.

Silver halide grains which are preferred in this invention are grains having non-homogenous structures such as a core/shell structure, a multilayer structure and an epitaxial structure, and particularly preferably those having a core/shell structure.

In the preferred embodiment of this invention using the core/shell grains, it is preferable that the average silver iodide content of the core is greater than the silver iodide content of the shell. The difference in the silver iodide content of the core and the shell is preferably 3 mol % or greater and particularly preferably to 5 mol %. The ratio (molar ratio) for the amount of silver in the shell to that in the core is preferably 1/1 to 9/1, and particularly preferably 3/1 to 5/1.

The form of the silver halide grains according to this invention may, for example, be cubic, octahedral, tetradecahedral, tabular or spherical, but cubic and tetradecahedral are preferred.

With respect to the size distribution of the silver halide grains, monodisperse silver halide emulsions with a variation coefficient of 20% or less and particularly preferably 15% or less are preferred.

The variation coefficient here is defined as:

$$\text{Variation coefficient (\%)} = \frac{\text{standard deviation in grain size}}{\text{average grain size value}} \times 100.$$

The photographic emulsions used in this invention can be prepared using methods described, for example, in *Chimie et Physique Photographique* by P. Glafkides (published by Paul Montel, 1967), *Photographic Emulsion Chemistry* by G. F. Duffin (published by The Focal Press, 1966), and *Making and Coating Photographic Emulsion* by V. L. Zelikman et al. (published by The Focal Press, 1964).

Thus, the acidic method, neutral method, ammonia method and the like are all permissible, and the one-sided mixing method, simultaneous mixing method or a combination of these may be used as the system for reacting the soluble silver salts with the soluble halogen salts.

It is possible to use the method in which the grains are formed in an excess of silver ions (the so-called reverse mixing method). By way of one form of the simultaneous mixing method, it is possible to use the method in which the pAg is kept constant in the liquid phase in which the silver halide is formed, in other words the so-called controlled double jet method.

With this method, silver halide emulsions in which the crystal form is regular and the grain size is close to uniform are obtained.

Further, in order to make the grain size uniform, it is preferable to carry out rapid growth in a region in which the critical saturation is not exceeded using a method in which the addition rates for the silver nitrate and the alkali halides are varied in accordance with the grain growth rate as described in G.B. Patent 1,535,016, JP-B-48-36890, and JP-B-52-16364; or the method in which the concentrations of the aqueous solutions are varied as described in G.B. Patent 4,242,445 and JP-A-55-158124.

Further, in the case of tabular grains, it is preferable to use grains with a uniform grain size and/or thickness as described in, for example, JP-B-47-11386, Japanese Patent Application 61-48950 and JP-A-63-151618.

Moreover, as regards the production of core/shell type emulsions, it is possible to use known methods, and reference may be made, for example, to the descriptions in JP-B-49-21657, JP-A-51-39027, JP-A-54-118823, JP-A-58-108528, JP-A-59-29243, JP-A-59-52237, JP-A-59-74548, JP-A-59-116645 and JP-A-59-149344.

It is possible to use water-soluble iridium compounds as the iridium compounds used in this invention. For example, it is possible to mention halogenated iridium (III) compounds and halogenated iridium (IV) compounds or complex iridium salts having a halogen, amine or oxalate as the ligand, for example complex hexachloroiridium (III) or (IV) salts, complex hexamine iridium (III) or (IV) salts, complex trioxalate iridium (III) or (IV) salts or the like. In this invention it is possible to use arbitrary combinations of trivalent and tetravalent versions of these compounds. These iridium compounds are used by dissolving in water or a suitable solvent, and it is possible to use a method generally well employed to stabilize solutions of iridium compounds, which is to say a method involving the addition of an aqueous hydrogen halide solution (for example, hydrochloric acid, bromic acid or hydrofluoric acid) or of an alkali halide (for example, KCl, NaCl, KBr, NaBr). Instead of using the water-soluble iridium compound, it is also possible to effect dissolution by adding separate silver halide grains which have previously been doped with iridium during the preparation of the silver halide grains according to this invention.

The total addition amount of the iridium compounds added during the preparation of the silver halide grains according to this invention is appropriately $5\times10^{-9}$ to $1\times10^{-6}$ mole, preferably $1\times10^{-8}$ to $1\times10^{-6}$ mole and most preferably $5\times10^{-8}$ to $5\times10^{-7}$ mole per mole of silver halide finally formed.

By way of iron compounds used in this invention, it is possible to mention potassium hexacyanoferric(III) acid and potassium hexacyanoferric(II) acid, ferrous sulfate, ferric chloride and suchlike. The amount of iron compounds added is appropriately $5\times10^{-8}$ to $1\times10^{-3}$ mole, and preferably $1\times10^{-7}$ to $1\times10^{-4}$ mole per mole of silver halide finally formed.

The iridium compound and iron compound can be added in any stage during the silver halide grain formation. It is similarly possible to add the iridium compound and iron compound during any stage of the grain formation with the grains with a core/shell structure which are the preferred silver halide grains of this invention, but it is preferable to bias the iron compound to be present in the shell, and it is particularly preferable to bias both the iridium compound and the iron compound to be present in the shell.

Cadmium salts, zinc salts, lead salts, thallium salts, rhodium salts or complex salts thereof and the like may coexist during the silver halide grain formation or physical ripening stages.

By way of silver halide solvents which may be used in this invention, it is possible to mention (a) organic thioethers as described, for example, in U.S. Pat. Nos. 3,271,157, 3,531,289 and 3,574,628, (b) thiourea derivatives as described in JP-A-53-82408 and JP-A-55-77737, (c) silver halide solvents having oxygen or carbonyl groups as described in JP-A-53-144319, (d) imidazoles, (e) sulfites and (f) thiocyanates as described in JP-A-54-100717. Of these, thioethers are particularly preferred.

Specific compounds are given below.

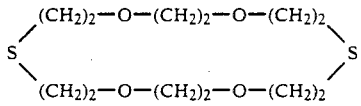

$$CH_2-NHCOCH_2CH_2COH$$
$$|$$
$$CH_2-S-CH_2CH_2SC_2H_5$$

$$HO-(CH_2)_2-S-(CH_2)_2-S-(CH_2)_2-OH$$

The silver halide emulsions of this invention preferably undergo gold sensitization and sulfur sensitization.

There are various gold salts for the gold sensitizers used in this invention, examples including potassium chloroaurite, potassium auric thiocyanate, potassium chloroaurate and auric trichloride. Specific examples are described in the specifications of U.S. Pat. Nos. 2,399,083 and 2,642,361.

In addition to the sulfur compounds contained in gelatin, it is possible to use various sulfur compounds such as thiosulfates, thioureas, thiazoles, thiocyanates and the like as the sulfur sensitizers used in this invention. Specific examples are those described in U.S. Pat. Nos. 1,574,944, 2,278,947, 2,410,689, 2,728,668, 3,501,313 and 3,656,955. Preferred sulfur compounds are thiosulfates and thiourea compounds.

The preferred addition amount for the sulfur sensitizers and the gold sensitizers is $1\times10^{-2}$ to $1\times10^{-7}$ mole and more preferably $1\times10^{-3}$ to $1\times10^{-5}$ mole per mole of silver, respectively.

As a molar ratio, the ratio of the sulfur sensitizers to the gold sensitizers is $\frac{1}{3}$ to 3/1 and preferably $\frac{1}{2}$ to 2/1.

In addition to the gold sensitizers, complex salts of other precious metals such as platinum, palladium and iridium may also be included without impediment in this invention.

It is possible to use a reduction sensitization method in this invention.

By way of reduction sensitizers, stannous salts, amines, formamidinesulfinic acid and silane compounds and the like can be used.

The photosensitive silver halide emulsions of this invention may be spectrally sensitized to relatively longer wavelength blue light, green light, red light or infrared light by means of sensitizing dyes. By way of sensitizing dyes, it is possible to use cyanine dyes, merocyanine dyes, complex cyanine dyes, complex merocyanine dyes, holopolar cyanine dyes, styryl dyes, hemicyanine dyes, oxonol dyes, hemioxonol dyes and the like.

Useful sensitizing dyes used in this invention are described, for example, in the descriptions in *Research Disclosure* Item 17643, section IV-A, (p. 23 December 1978) and Research Disclosure Item 1831, section X, (p. 437 August 1979) and in the literature cited therein.

These sensitizing dyes may be used singly or they may be used in combination and combinations of sensitizing dyes are often used for supersensitization in particular. A dye or substance which does not itself have a spectral sensitization effect or which essentially does not absorb visible light but which exhibits supersensitization when used together with the sensitizing dye may be included in the emulsion.

Useful sensitizing dyes, combinations of dyes exhibiting supersensitization and substances exhibiting supersensitization are described in *Research Disclosure,* Vol. 176, 17643, section J in IV of page 23 (published December 1978).

Various compounds can be included in the photosensitive materials of this invention in order to prevent fogging of the photosensitive material during the production process, storage or photographic processing or to stabilize the photographic performance. Thus, it is possible to add any of many compounds which are known as antifoggants or stabilizers such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazoline thione; azaindenes such as triaazaindenes, tetraazaindenes (in particular, 4-hydroxy-substituted (1,3,3a,7)tetraazaindenes) and pentaazaindenes; and benzenethiosulfonic acid, benzenesulfinic acid, and benzenesulfonic acid amide.

In order to increase the speed, increase the contrast or accelerate development, the photographic emulsion layers of the photographic materials of this invention may contain developing agents such as polyalkyleneoxides or derivatives such as the ethers, esters or amines thereof, thioether compounds, thiomorpholines, quaternary ammonium salt compounds, urethane derivatives, urea derivatives, imidazole derivatives and dihydroxybenzenes and 3-pyrazolidones. Of these, dihydroxybenzenes (for example, hydroquinone, 2-methylhydroquinone and catechol) and 3-pyrazolidones (for example, 1-phenyl-3-pyrazolidone and 1-phenyl-4-methyl-4-hydroxymethyl-3-pyrazolidone) are preferred and these are normally used at 5 g/m$^2$ or less. The dihydroxybenzenes are preferably at 0.01 to 1 g/m$^2$, and the 3-pyrazolidones are preferably at 0.01 to 0.2 g/m$^2$.

The photosensitive materials produced using this invention may contain water-soluble colorants as filter dyes in hydrophilic colloid layers or for irradiation prevention or various other purposes. Such colorants include oxonol dyes, hemioxonol dyes, styryl dyes, merocyanine dyes, cyanine dyes and azo dyes. Of these the oxonol dyes, hemioxonol dyes and merocyanine dyes are useful.

The photographic emulsions and non-photosensitive hydrophilic colloids of this invention may contain inorganic or organic film hardeners. For example, it is possible to use, either singly or in combination, active vinyl compounds (for example, 1,3,5-triacryloylhexahydrostriazine, bis(vinylsulfonyl)methyl ether, N,N-methylenebis-[β-(vinylsulfonyl)propionamide]), active halogen compounds (for example, 2,4-dichloro-6-hydroxystriazine), mucohalic acids (for example mucochloric acid), N-carbamoyl pyridinium salts (for example (1-morpholinocarbonyl-3-pyridinio)methane sulfonate), or haloamidinium salts (for example 1-(1-chloro-1-pyridinomethylene)pyrolidinium and 2- phthalene sulfonate). Of these, the active vinyl compounds described in JP-A-53-41220, JP-A-53-57257, JP-A-50-162546 and JP-A-60-80846 and the active halogen compounds described in U.S. Pat. No. 3,325,287 are preferred.

The photographic emulsion layers or other hydrophilic colloid layers of the photosensitive materials produced using this invention may contain various surfactants for various purposes such as coating aid, static prevention, improving slip properties, emulsification dispersion, adhesion prevention and photographic characteristic improvement (for example, development acceleration, harder gradation, sensitization).

For example, it is possible to use nonionic surfactants such as saponin (steroid type), alkylene oxide derivatives (for example, polyethylene glycol, polyethylene glycol/polypropylene glycol condensates, polyethylene glycol alkyl ethers or polyethylene glycol alkylargyl ethers, polyethylene glycol esters, polyethylene glycol sorbitan esters, polyalkylene glycol alkylamines or amides and polyethylene oxide adducts of silicones), glycidol derivatives (for example, alkenyl succinate polyglydceride and alkylphenol polyglyceride), polyhydric alcohol fatty acid esters and alkyl esters of sugars; anionic surfactants containing acidic groups such as the carboxyl group, sulfo group, phospho group, sufuric acid ester group, and phosphoric acid ester group, examples including alkylcarboxylates, alkylsulfonates, alkylbenzenesulfonates, alkylnaphthalenesulfonates, alkylsulfate esters, alkylphosphate esters, N-acyl-N-alkyltaurines, sulfonsuccinic acid esters, sulfoalkylpolyoxyethylene alkylphenyl ethers and polyoxyethylene alkylphosphate esters; and amphoteric surfactants such as amino acids aminoalkyl sulfonates, aminoalkyl sulfuric acid or phosphoric acid esters, alkylbetains and amine oxides; and cationic surfactants such as alkylamine salts, aliphatic or aromatic quaternary ammonium salts, pyridinium, imidazolium and other such heterocyclic quaternary ammonium salts and phosphonium or sulfonium salts containing aliphatic or heterocyclic rings.

Furthermore, it is preferable to use a fluorine-containing surfactant as described, for example, in JP-A-60-80849 for static prevention.

The photographic materials of this invention can contain a matting agent such as chitin, magnesium oxide, or polymethyl methacrylate for the purpose of preventing adhesion in the photographic emulsion layer or other hydrophilic colloid layer.

The photosensitive materials used in this invention can contain dispersions of synthetic polymers which are sparingly soluble or insoluble in water for the purpose of dimensional stability. For example, it is possible to use, either singly or in combination, alkyl (meth)acrylate, alkoxyalkyl (meth)acrylate, glycidyl (meth)acrylate and the like, or polymers which have these and acrylic acid or methacrylic acid or other such combinations for their monomer components.

It is advantageous to use gelatin as the binder or protective colloid for the photographic emulsion, but it is also possible to use other hydrophilic colloids. For example, it is possible to use proteins such as albumin and casein, and a great variety of synthetic hydrophilic macromolecular substances such as homo- or copolymers of, for example gelatin derivatives, graft polymers of gelatin and other macromolecules, hydroxyethylcellulose, carboxymethylcellulose, cellulose sulfate esters and other such cellulose derivatives, sodium alginate, starch derivatives and other such sugar derivatives, polyvinyl alcohol, polyvinyl alcohol part acetal, poly-N-vinylpyrrolidone, polyacrylic acid, polymethacrylic acid, polyacrylamide, polyvinylimidazole and polyvinylpyrazole.

In addition to lime-treated gelatin, acid-treated gelatin may be used as the gelatin, and it is also possible to use hydrolysis products of gelatin and enzymolysis products of gelatin.

The silver halide emulsion layers used in this invention can contain polymer latexes such as alkyl acrylate.

Cellulose triacetate, cellulose diacetate, nitrocellulose polystyrene polyethylene terephthalate paper, baryta coated paper, polyolefin coated paper and the like can be used as the support for the photosensitive material in this invention.

There are no particular limits on the developing agents employed in the developing solutions used in this invention, but it is preferable that they include dihydroxybenzenes and there will be cases involving the use of a combination of dihydroxybenzenes and 1-phenyl-3-pyrazolidones and cases using a combination of dihydroxybenzenes and p-aminophenols.

By way of dihydroxybenzene developing agents used in this invention, there are hydroquinone, chlorohydroquinone, bromohydroquinone, isopropylhydroquinone, methylhydroquinone, 2,3-dichlorohydroquinone,2,5-dichlorohydroquinone, 2,3-dibromohydroquinone, 2,5-dimethylhydroquinone and the like, and hydroquinone is particularly preferred.

By way of 1-phenyl-3-pyrazolidone or derivatives thereof, which are developing agents used in this invention, there are 1-phenyl-3-pyrazolidone, 1-phenyl-4,4-dimethyl-3-pyrazolidone, 1-phenyl-4-methyl-4-hydroxy-methyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxy-methyl-3-pyrazolidone.

The p-aminophenol developing agents used in this invention include N-methyl-p-aminophenol, p-aminophenol, N-(β-hydroxyethyl)-p-aminophenol) N-(4-hydroxyphenyl)glycine, 2-methyl-p-aminophenol and p-benzylaminophenol, and N-methyl-p-aminophenol is preferred amongst these.

The developing agents are normally preferably used at an amount of 0.05 mol/l to 0.8 mol/l. Further, when using a combination of dihydroxybenzenes and 1-phenyl-3-pyrazolidones or p-aminophenols, the former is preferably used at amount of 0 05 mol/l to 0.5 mol/l and the latter at 0.06 mol/l or less.

Sulfite preservatives used in the developer which may be used to develop the photosensitive material of this invention include sodium sulfite, potassium sulfite, lithium sulfite, ammonium sulfite, sodium bisulfite, potassium metabisulfite and sodium formaldehyde bisulfite. The sulfite salts are preferably at 0.3 mol/l or greater, particularly preferably at 0.4 mol/l or greater. Further, it is preferable to adopt an upper limit of 2.5 mol/l, particularly preferably 1.2 mol/l.

The alkali agents used to set the pH include pH adjusters and buffering agents such as sodium hydroxide, potassium hydroxide, sodium carbonate, potassium carbonate, sodium triphosphate, potassium triphosphate, sodium silicate and potassium silicate.

By way of additives which are used apart from the above constituents, it is possible to include development inhibitors such as boric acid, borax and other such compounds, sodium bromide, potassium bromide and potassium iodide; organic solvents such as ethylene glycol, diethylene glycol, triethylene glycol, dimethyl formamide, methylcellosolve, hexylene glycol, ethanol and methanol; and antifoggants or black pepper preventors such as 1-phenyl-5-mercaptotetrazole and sodium 2-mercaptobenzimidazole-5-sulfonate and other such mercapto-based compounds, 5-nitroindazole and other such indazole-based compounds, 5-methylbenzotriazole and other such benzotriazole-based compounds, and it is also possible to include toning agents, surfactants, defoaming agents, water softeners, film hardeners and the amino compounds described in JP-A-56-106244 and such like as desired.

It is possible to use the compounds described in JP-A-56-24347 as silver staining preventors, the compounds described in JP-A-62-212651 as development unevenness preventors, and the compounds described in JP-A-61-267759 as auxiliary solvents in the development solutions used in this invention.

Boric acid as described in JP-A-62-186259, saccharides (for example, saccharose) as described in JP-A-60-93433, oximes (for example, acetoxime), phenols (for example, 5-sulfosalicylic acid), triphosphoric acid salts (for example the sodium salt or potassium salt) are used as buffers in the developing solutions used in this invention, and boric acid is used for preference.

The fixing solution is an aqueous solution containing, in addition to the fixing agents, film hardeners (for example, water-soluble aluminum compounds), acetic acid and dibasic acids (for example, tartaric acid, citric acid or salts thereof) and preferably has a pH of 3.8 or greater, more preferably of 4.0 to 5.5.

Fixing agents include sodium thiosulfate and ammonium thiosulfate, ammonium thiosulfate being particularly preferred from the standpoint of the fixing rate. The amount of fixing agents used can be varied as appropriate and is generally about 0.1 to about 5 mol/l.

Water-soluble aluminum salts which mainly function as film hardeners in the fixing solution are compounds which are generally known as film hardeners for acidic film hardening fixing solutions, examples including aluminum chloride, aluminum sulfate and potash alum.

By way of the dibasic acids mentioned above, it is possible to use singly or make conjoint use of 2 or more of tartaric acid or its derivatives and citric acid or its derivatives. It is effective to include these compounds at 0.005 mole or greater per liter of fixing solution, and particularly effective at 0.01 mol/l to 0.03 mol/l.

Specifically, there are tartaric acid, potassium tartrate, sodium tartrate, potassium sodium tartrate, ammonium tartrate, ammonium potassium tartrate and the like.

As examples of citric acid or derivatives thereof which are useful in this invention, there are citric acid, sodium citrate, potassium citrate and the like.

The fixing solution can further contain preservatives (such as sulfite salts and bisulfite salts), pH buffers (such as acetic acid and boric acid), pH adjusters (such as ammonia and sulfuric acid), image preservation improvers (such as potassium iodide) and chelating agents as desired. Since the pH of the developing solution is high, the pH buffers are used here in amounts of 10 to 40 g/l and preferably 18 to 25 g/l.

The fixing temperature and time are similar to the situation for development and are preferably about 20° C. to about 50° C. and 10 sec. to 1 min.

Further, the washing water may contain antifungal agents (for example, the compounds described in *Bokin Bobai No Kaqaku* (The chemistry of bacterial and fungal prevention) by Horiguchi and in the specification of JP-A-62-115154, washing accelerators (for example, sulfite salts) and chelating agents.

According to the above mentioned method, the photographic material which has been developed and fixed is subjected to washing and drying. The washing is carried out in order to almost completely remove the silver salts which are dissolved by fixing and is preferably at about 20° C. to about 50° C. for 10 sec. to 3 min. The drying is carried out at about 40° C. to about 100° C. and the drying time can be varied appropriately in accordance with surrounding conditions but is normally about 5 sec. to 3 min. 30 sec.

A roller conveyor automatic developing apparatus is described, for example, in the specifications of U.S. Pat. Nos. 3,025,779 and 3,545,971 and in this specification reference will simply be made to a roller conveyor processor. The roller conveyor processor comprises the four stages of development, fixing, washing and drying, and it is most preferable to follow these four stages in this invention as well, although other stages (for example, a stop stage) are not excluded. Here, it is possible to conserve water in the washing stage by the use of a 2- or 3-stage countercurrent washing system.

The developing solution used in this invention is preferably stored in a wrapping material with a low oxygen permeability as described in JP-A-61-73147. Further, the replenishment system described in JP-A-62-91939 can be used for preference with the developing solutions used in this invention.

The invention is explained specifically by means of examples below, but the invention is not limited by these.

EXAMPLE 1

Preparation of emulsions

Emulsions A to F were prepared by the following method.

[Emulsion A]: A mixed aqueous solution of potassium iodide and potassium bromide and an aqueous silver nitrate solution were added to an aqueous gelatin solution containing 1,8-dihydroxy-3,6-dithiaoctane with stirring vigorously at 75° C. for 15 minutes while controlling the pAg at 8.0 thereby obtaining a monodisperse octahedral silver iodobromide emulsion with an average grain size of 0.25μ and an iodine content of 6 mol %. This silver iodobromide emulsion was used as the core and an aqueous potassium bromide solution and an aqueous silver nitrate solution were added in such a way that the pAg was 7.4 thereby obtaining a core/shell silver iodobromide emulsion. This emulsion was subjected to desalting following a common method and then chemical sensitization was carried out at 60° C. for 70 minutes with the addition of $1.9\times10^{-5}$ mole of sodium thiosulfate and $1.2\times10^{-5}$ mole of chloroauric acid for every mole of silver. 30 ml of a 1% solution of 4-hydroxy-6-methyl-1,3,3a,7-tetraazaindene was added per mole of silver as a stabilizer, ultimately giving a monodisperse cubic emulsion (variation coefficient 10%) with an average silver iodide content of 1.5 mol % and an average grain size of 0.45 μm.

[Emulsion B]: A monodisperse cubic emulsion (variation coefficient 10%) with an average silver iodide content of 1.5 mol % and an average grain size of 0.45 μm was obtained in exactly the same way as Emulsion A, except that grain formation was carried out with the addition of $K_3IrCl_6$ to the aqueous potassium bromide solution during shell formation to constitute $1\times10^{-7}$ mole per mole of Ag.

[Emulsion C]: A monodisperse cubic emulsion (variation coefficient 10%) with an average silver iodide content of 1.5 mol % and an average particle size of 0.45 μm was obtained in exactly the same way as Emulsion A, except that grain formation was carried out with the addition of $K_3IrCl_6$ to the aqueous potassium bromide solution during shell formation to constitute $0.6\times10^{-8}$ mole per mole of Ag.

[Emulsion D]: A monodisperse cubic emulsion (variation coefficient 10%) with an average silver iodide content of 1.5 mol % and an average grain size of 0.45 μm was obtained in exactly the same way as Emulsion A, except that grain formation was carried out with the addition of $K_4[Fe(CN)_6]$ to the aqueous potassium bromide solution during shell formation to constitute $1.5\times10^{-5}$ mole per mole of Ag.

[Emulsion E]: A monodisperse cubic emulsion (variation coefficient 10%) with an average silver iodide content of 1.5 mol % and an average grain size of 0.45 μm was obtained in exactly the same way as Emulsion A, except that grain formation was carried out with the addition of $K_3IrCl_6$ and $K_4[Fe(CN)_6]$ to the aqueous potassium bromide solution during shell formation to constitute $1\times10^{-7}$ mole and $1.5\times10^{-5}$ mole per mole of Ag, respectively.

[Emulsion F]: A monodisperse cubic emulsion (variation coefficient 10%) with an average silver iodide content of 1.5 mol % and an average grain size of 0.45 μm was obtained in exactly the same way as Emulsion A, except that grain formation was carried out with the addition of $K_3IrCl_6$ and $K_4[Fe(CN)_6]$ to the aqueous potassium bromide solution during shell formation in such a way as to constitute $0.6\times10^{-8}$ mole and $1.5\times10^{-5}$ mole per mole of Ag, respectively.

Production of coated samples 50 mg per mole of silver respectively of compounds (I) and (II) were added to the abovementioned emulsions as spectrally sensitizing dyes with the further addition of 150 mg/m$^2$ of hydroquinone and 25 mg per mole of silver of 1-phenyl-5-mercaptotetrazole as antifoggants, a 25% based on the weight of gelatin binder of a polyethyl acrylate latex as a plasticizer, 80 mg/m$^2$ of 2-bis(vinylsulfonylacetamido)ethane as a film hardener, 40 mg/m$^2$ of 2,4-dichloro-6-hydroxy-s-triazine and 200 mg/m$^2$ of the polymer latex denoted as compound (III), and coating was carried out to a silver amount of 4.5 g/m$^2$ on a polyester support. The gelatin constituted 3.5 g/m$^2$.

Onto this there were coated simultaneously an upper protective layer to which there had been added 0.7 g/m$^2$ of gelatin, 60 mg/m$^2$ of polymethyl methacrylate with a particle size of 3 to 4μ, 70 mg/m$^2$ of colloidal silica with a particle size of 10 to 20 mμ and 100 mg/m$^2$ of silicone oil as matting agents, and to which there had been added sodium dodecylbenzene sulfonate and the fluorine-based surfactant given as compound (IV) as coating aids, and a lower protective layer to which there had been added 0.9 g/m$^2$ of gelatin, 225 mg/m$^2$ of polyethyl acrylate latex, 200 mg/m$^2$ of the dye of compound (V), 200 mg/m$^2$ of the dye of (VI) and, as an coating aids, sodium dodecylbenzene sulfonate.

Compounds (I)

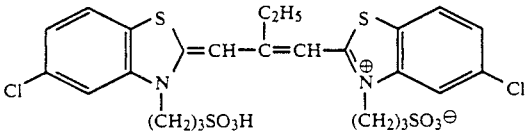

(II)

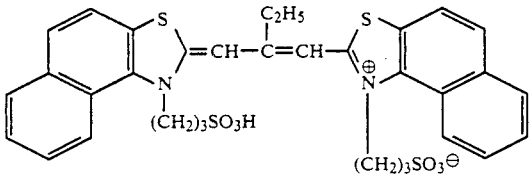

(III)

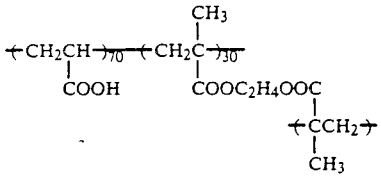

(IV)

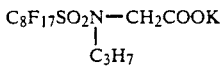

(V)

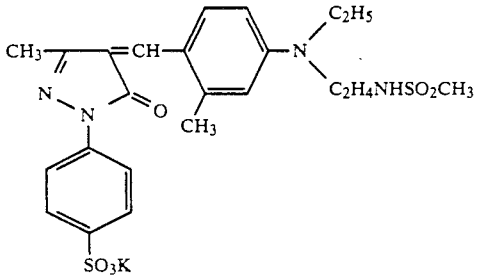

-continued

Compounds (VI)

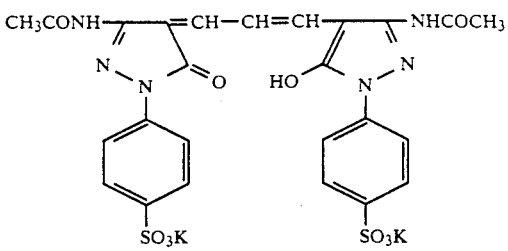

Evaluation of speed and gradation

The resulting samples were exposed under a xenon flashlight with an emission time of $10^{-5}$ seconds via a continuous wedge and an interference filter having its peak at 670 nm.

Further, after developing for 30 seconds at 35° C. using a developing solution of the following composition, fixing was carried out for 60 seconds at 25° C. using a fixing solution with the following composition and washing and drying were carried out and the densities were measured.

The reciprocal of the exposure giving a density of 3.0 denotes speed, and relative speeds are given in Table 1.

The gradient of the straight line connecting the point for a density of 0.3 with the point for a density of 3.0 on the characteristic curve is taken as the gradation and is similarly shown in Table 1.

Evaluation of safelight stability

The resulting samples were left for 3 minutes in a position 1 m away from a light source with the interposition of a green safelight filter, a 20 W bulb being used as the light source, and then development, fixing and drying were carried out in the same way as for the speed evaluation and the difference in the fogging densities of a product which had not been exposed to the safelight and the products which had been exposed to the safelight was measured. The results are given in Table 1. The larger the fogging density, the worse the handling properties.

| Developing solution formulation: | |
|---|---|
| Water | 720 ml |
| Disodium ethylenediaminetetraacetate | 2 g |
| Sodium hydroxide | 44 g |
| Sodium sulfite | 45 g |
| Sodium carbonate | 26.4 g |
| Boric acid | 1.6 g |
| Potassium bromide | 1 g |
| Hydroquinone | 36 g |
| Diethylene glycol | 39 g |
| 5-Methylbenzotriazole | 0.2 g |
| 2-Methylimidazole | 2 g |
| 1-Phenyl-3-pyrazolidone | 0.7 g |
| Water to make | 1 liter |
| Fixing solution formulation | |
| Ammonium thiosulfate | 170 g |
| Sodium sulfite (anhydrous) | 15 g |
| Boric acid | 7 g |
| Glacial acetic acid | 15 ml |
| Potash alum | 20 g |
| Ethylenediaminetetraacetic acid | 0.1 g |
| Tartaric acid | 3.5 g |
| Water to make | 1 liter |

TABLE 1

| Sample | Emulsion | Relative speed | Gradation | Fog density difference | |
|---|---|---|---|---|---|
| 1 | A | 100 | 3.1 | 0.03 | |
| 2 | B | 148 | 5.6 | 0.12 | |
| 3 | C | 134 | 5.2 | 0.06 | |
| 4 | D | 118 | 4.3 | 0.05 | |
| 5 | E | 165 | 5.9 | 0.12 | This invention |
| 6 | F | 150 | 5.8 | 0.06 | This invention |

As is clear from Table 1, it will be seen that the Samples 5 and 6 which correspond to this invention are outstanding in their speeds and gradation as compared to the other samples and that their handling properties are good. To explain in further detail, Sample 1 which contained no $K_3IrCl_6$ or $K_4[Fe(CN)_6]$ has a low speed and a soft gradation. In contrast, Samples 2 and 3 to which only $K_3IrCl_6$ had been added achieved a high speed and hard gradation, but the difference in the fogging densities were large and the handling properties deteriorated markedly. On the other hand, to compare Sample 6 with Sample 3, while they have equivalent speeds and gradation, Sample 6, which corresponds to this invention, has a smaller difference in fogging density than Sample 3 and it is possible to provide a photosensitive material which has a higher speed and harder gradation and more outstanding handling properties than cases involving the use of $K_3IrCl_6$ alone.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide photosensitive emulsion layer, wherein said silver halide photosensitive emulsion layer contains silver iodobromide grains having a silver iodide content of 0.1 to 4.0 mol %, said grains containing $5\times10^{-9}$ to $1\times10^{-6}$ mole of an iridium compound and $5\times10^{-8}$ to $1\times10^{-3}$ mole of an iron compound per mole of the silver halide in said silver iodobromide grains.

2. A silver halide photographic material according to claim 1, wherein the amount of iridium compound contained in said silver iodobromide grains is from $1\times10^{-8}$ to $1\times10^{-6}$ mole per mole of silver halide in said silver iodobromide grains.

3. A silver halide photographic material according to claim 1, wherein the amount of iron compound is from $1\times10^{-7}$ to $1\times10^{-4}$ mole per mole of silver halide in said silver iodobromide grains.

4. A silver halide photographic material according to claim 1, wherein said silver iodobromide grains contain essentially no silver chloride.

5. A silver halide photographic material according to claim 1, wherein said silver iodobromide grains contain from 0.5 to 2 mol % silver iodide.

6. A silver halide photographic material according to claim 1, wherein the silver iodobromide grains have a core/shell structure wherein the silver iodide content of the shell is lower than the silver iodide content of the core, and wherein the molar ratio of the amount of silver in the shell to the amount in the core is from 1/1 to 9/1.

7. A silver halide photographic material according to claim 1, wherein the silver iodobromide grains have a core/shell structure wherein the silver iodide content of the shell is lower than the silver iodide content of the core, and wherein the difference in the silver iodide content of the core and the shell is 3 mol % or more.

8. A silver halide photographic material according to claim 1, wherein the iridium compound and the iron compound are primarily present in the shell.

9. A process for forming an image comprising imagewise exposing for a period of $10^{-3}$ to $10^{-9}$ seconds a silver halide photographic material comprising a support having provided thereon at least one silver halide photosensitive emulsion layer, wherein said silver halide photosensitive emulsion layer contains silver iodobromide grains having a silver iodide content of 0.1 to 4.0 mol %, said grains containing $5\times10^{-9}$ to $1\times10^{-6}$ mole of an iridium compound and $5\times10^{-8}$ to $1\times10^{-3}$ mole of an iron compound per mole of the silver halide in said silver iodobromide grains, followed by developing the exposed silver halide photosensitive material.

10. A silver halide photographic material according to claim 1, wherein said iridium compound is selected from the group consisting of $K_3IrCl_6$(III) and $K_2IrCl_6$(IV).

11. A silver halide photographic material according to claim 1, wherein said iron compound is selected from the group consisting of potassium hexacyanoferric(III) acid and potassium hexacyanoferric(II) acid.

* * * * *